US006422194B2

(12) United States Patent
Ito et al.

(10) Patent No.: US 6,422,194 B2
(45) Date of Patent: Jul. 23, 2002

(54) HANDHELD TYPE FOUR-CYCLE ENGINE

(75) Inventors: Keita Ito; Takao Nishida; Sei Watanabe, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/801,924

(22) Filed: Mar. 9, 2001

(30) Foreign Application Priority Data

Mar. 16, 2000 (JP) ..... 2000-79307
Mar. 16, 2000 (JP) ..... 2000-79308

(51) Int. Cl.[7] ..... F01M 9/10
(52) U.S. Cl. ..... 123/196 R
(58) Field of Search ..... 123/572, 658, 123/90.39, 90.48, 41.65, 41.7, 196 R, 196 M

(56) References Cited

U.S. PATENT DOCUMENTS 4,424,772 A * 1/1984 Porter ..... 123/658
4,813,408 A 3/1989 Katsumoto et al. ... 123/196 AB
5,947,068 A 9/1999 Akaki ..... 123/90.31
6,152,098 A 11/2000 Becker et al. ..... 123/196 R

FOREIGN PATENT DOCUMENTS

| | | |
|---|---|---|
| EP | 0 779 412 A2 | 6/1997 |
| EP | 0 887 520 A1 | 12/1998 |
| EP | 0 962 630 A2 | 12/1999 |
| JP | 10-288019 | 10/1998 |
| WO | WO 99/02824 | 1/1999 |

* cited by examiner

*Primary Examiner*—Marguerite McMahon
*Assistant Examiner*—Hyder Ali
(74) *Attorney, Agent, or Firm*—Armstrong, Westerman & Hattori, LLP

(57) ABSTRACT

With regard to a handheld type four-cycle engine including, in a side wall of a cylinder block, an intake valve, an exhaust valve and a valve operation mechanism operable in association with a crankshaft so as to open and close the above-mentioned valves and, an oil tank is formed in one side wall of the cylinder block, and the oil tank houses the valve operation mechanism and oil mist generation means for generating an oil mist from stored oil. It is thus possible to reliably lubricate the valve operation mechanism regardless of the operational position of the engine while allowing the size and weight of the engine main body to be reduced.

6 Claims, 5 Drawing Sheets

HANDHELD TYPE FOUR-CYCLE ENGINE

BACKGROUND OF THE INVENTION

1. Field of the Invention

The present invention relates to improvement of handheld type four-cycle engines which can desirably be used mainly as a power source for machines for portable operation such as trimmers.

2. Description of the Relevant Art

With regard to conventional handheld type four-cycle engines, one in which an oil mist generated from the oil stored in an oil reservoir is circulated inside the engine in order to lubricate the inside of the engine regardless of the operational position of the engine is already known in Japanese Patent Application Laid-open No. 10-288019.

However, the lubrication system disclosed in the above-mentioned patent publication has a comparatively long and complicated circulation route in which the oil mist is circulated from the oil tank to the crank chamber, then to the valve operation chamber and is then returned to the oil tank. Such a long and complicated circulation route for the oil mist causes an increase in the size of the engine main body, which includes the circulation route, and makes it difficult to reduce the weight thereof. Weight reduction is one of the important issues when considering improvements in the operability of, in particular, handheld type four-cycle engines.

SUMMARY OF THE INVENTION

The present invention has been carried out in view of the above-mentioned circumstances, and it is an object of the present invention to provide a handheld type four-cycle engine which can reliably lubricate the valve operation mechanism regardless of the operational position of the engine while making the engine main body more compact and lighter.

In accordance with a first characteristic of the present invention in order to achieve the above-mentioned objective, there is proposed a handheld type four-cycle engine including a crankcase having a crank chamber housing a crankshaft; a cylinder block having a cylinder bore; and an intake valve, an exhaust valve and a valve operation mechanism provided in a side wall of the cylinder block, the valve operation mechanism being operable in association with the crankshaft so as to open and close the intake valve and the exhaust valve, wherein an oil tank for storing oil is provided in one side wall running the length of the crankcase and the cylinder block, and the oil tank houses the valve operation mechanism and oil mist generation means for generating oil mist from the stored oil.

In accordance with the above-mentioned first characteristic, since the oil tank can be filled with the oil mist generated by the oil mist generation means, each part of the valve operation mechanism disposed inside the oil tank can be lubricated reliably by the above-mentioned oil mist regardless of the operational position of the engine. It is therefore unnecessary to provide the engine main body with a special oil supply passage for lubricating the valve operation mechanism, and the size and weight of the engine can thus be reduced. Moreover, since the oil tank is provided in one side wall running the length of the crankcase and the cylinder block, it is unnecessary to provide an oil reservoir in the lower part of the crankcase, and the total height of the engine can thus be reduced and the size of the engine can be further reduced.

In accordance with a second characteristic of the present invention, in addition to the above-mentioned first characteristic, there is proposed a handheld type four-cycle engine wherein an outward route and an return route are provided for communication between the oil tank and the crank chamber above the oil stored in the oil tank, and valve means is provided for introducing the positive pressure component of pressure pulsations generated in the crank chamber into the side of the oil tank.

The above-mentioned valve means corresponds to the one-way valve 51 described in the embodiment of the present invention below.

In accordance with the above-mentioned second characteristic, since the oil mist generated in the oil tank is circulated between the oil tank and the crank chamber by utilising the pressure pulsations of the crank chamber, the crankshaft and the piston can be lubricated regardless of the operational position of the engine. Moreover, since it is sufficient for the oil mist to merely circulate between the two chambers, that is to say, the oil tank and the crank chamber, the outward and return routes for providing communication between the two chambers can be made comparatively short and simple, and the size and weight of the engine can be further reduced.

In accordance with a third characteristic of the present invention, in addition to the above-mentioned first or second characteristics, there is proposed a handheld type four-cycle engine wherein a breather chamber is communicated with the return route between the valve means and the oil tank, and the breather chamber is communicated with an air cleaner of an intake system on one side and with a suction chamber communicated with the oil tank via an orifice on the other side.

In accordance with the above-mentioned third characteristic, the blowby gas generated in the crank chamber is transferred to the breather chamber together with the oil mist, and separated into gas and liquid. Then, the blowby gas is discharged to the air cleaner, and the liquefied oil flows into the suction chamber via the orifice and can be returned to the low pressure oil tank.

Furthermore, in accordance with a fourth characteristic of the present invention, there is proposed a handheld type four-cycle engine including a crankcase having a crank chamber housing a crankshaft; a cylinder block having a cylinder bore; and an intake valve, an exhaust valve and a valve operation mechanism provided in a side wall of the cylinder block, the valve operation mechanism being operable in association with the crankshaft so as to open and close the intake valve and the exhaust valve, characterised in that an oil tank for storing oil that is separate from the crank chamber is provided in one side wall running the length of the crankcase and the cylinder block, the oil tank houses the valve operation mechanism and oil mist generation means for generating oil mist from the stored oil and is arranged so that the oil mist generated inside the oil tank can be supplied to the crank chamber, a cooling fan driven by the crankshaft is placed so as to adjoin the oil tank, and a power output mechanism is provided on the crankshaft so that the crankcase is interposed between the power output mechanism and the oil tank.

In accordance with the above-mentioned fourth characteristic, since the oil tank is provided in one side wall running the length of the crankcase and the cylinder block, it is unnecessary to provide an oil reservoir in the lower part of the crankcase, the total height of the engine can thus be reduced and the engine can be made compact. Moreover, since the oil tank is filled with the oil mist generated by the oil mist generation means and the oil mist is supplied to the crank chamber, each component inside the crank chamber as well as the valve operation mechanism placed inside the oil tank can be lubricated reliably regardless of the operational position of the engine.

Furthermore, since the cooling fan is placed so as to adjoin the oil tank, the oil tank and, therefore, the stored oil and the oil mist inside the oil tank can be cooled effectively by the cooling air generated by the cooling fan, thus efficiently carrying out lubrication and cooling of each component.

Moreover, since the valve operation mechanism and the power output mechanism are linked to the two ends of the crankshaft, the loads arising from the valve operation mechanism and the power output mechanism, during operation of the engine, are applied to the two separate ends of the crankshaft, it is thus possible to prevent the load applied to the crankshaft, its bearings and the side wall of the crankcase from being localised and the durability thereof can be enhanced.

In accordance with a fifth characteristic of the present invention, in addition to the above-mentioned first or fourth characteristic, there is proposed a handheld type four-cycle engine wherein a carburettor and an exhaust muffler are placed on the two sides of the cylinder block along a direction perpendicular to the axes of both the cylinder bore and the crankshaft.

In accordance with the above-mentioned fifth characteristic, the carburettor and the exhaust muffler can be easily arranged without any obstruction from the oil tank, the cooling fan or the power output mechanism thus helping to make the engine more compact.

The above-mentioned oil mist generation means corresponds to the oil slingers 36 to 41 described in the embodiment of the present invention below, and the above-mentioned power output mechanism corresponds to the centrifugal clutch 31 described in the embodiment below.

The above-mentioned objectives, other objectives, characteristics and advantages of the present invention will become apparent from an explanation of preferable embodiments which will be described in detail below by reference to the attached drawings.

DESCRIPTION OF PREFERRED EMBODIMENTS

Figure 1:
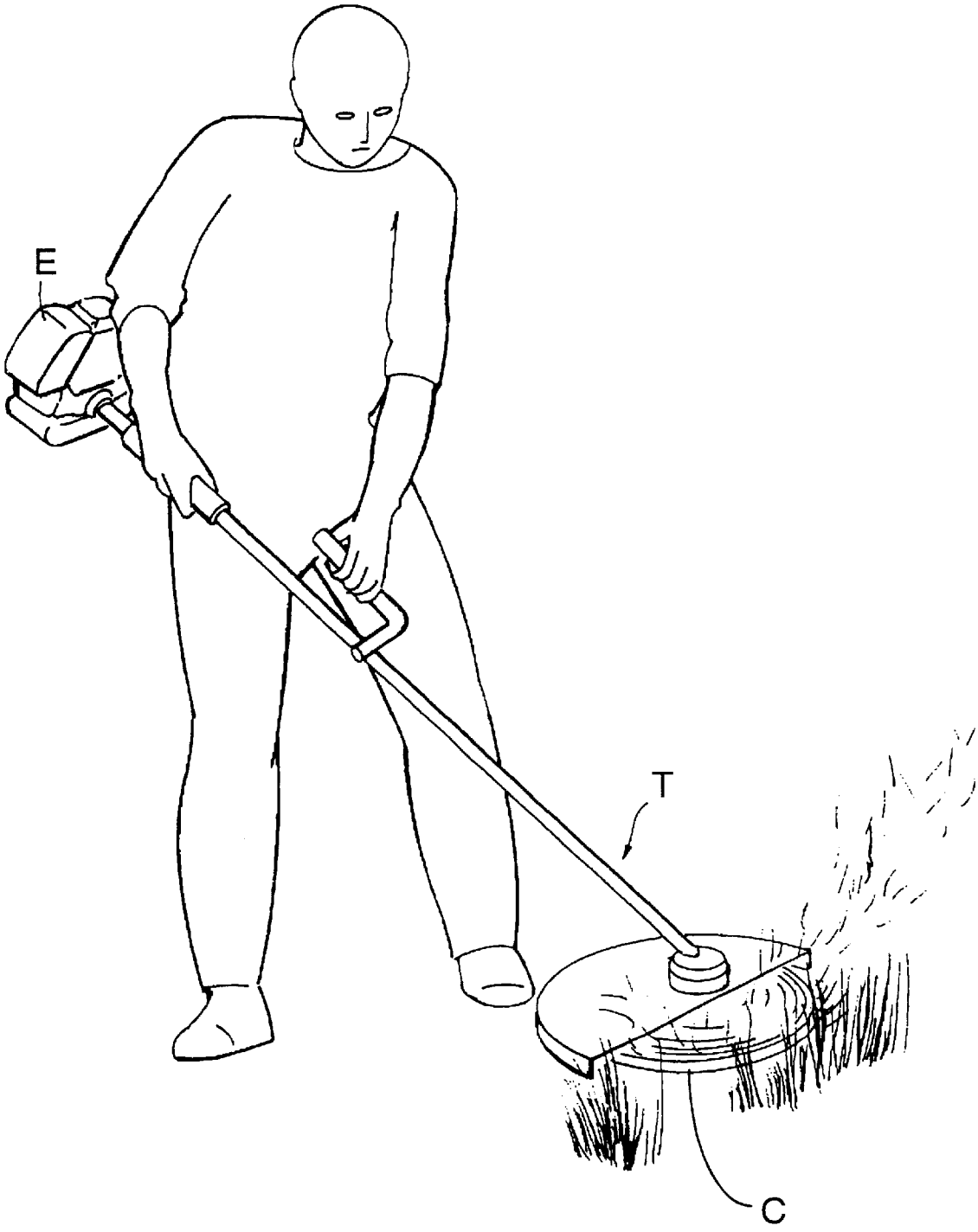
FIG. 1 is an oblique view showing one embodiment of the handheld type four-cycle engine of the present invention in practical use.

As shown in FIG. 1, a handheld type four-cycle engine E to which the present invention is applied is fitted as the source of power to the driving section of, for example, a powered trimmer T. Since the powered trimmer T is used in a manner in which a cutter C is positioned in various directions according to the operational conditions, the engine E is also tilted to a large extent or turned upside-down as a result, and the operational position is unstable.

Figure 2:
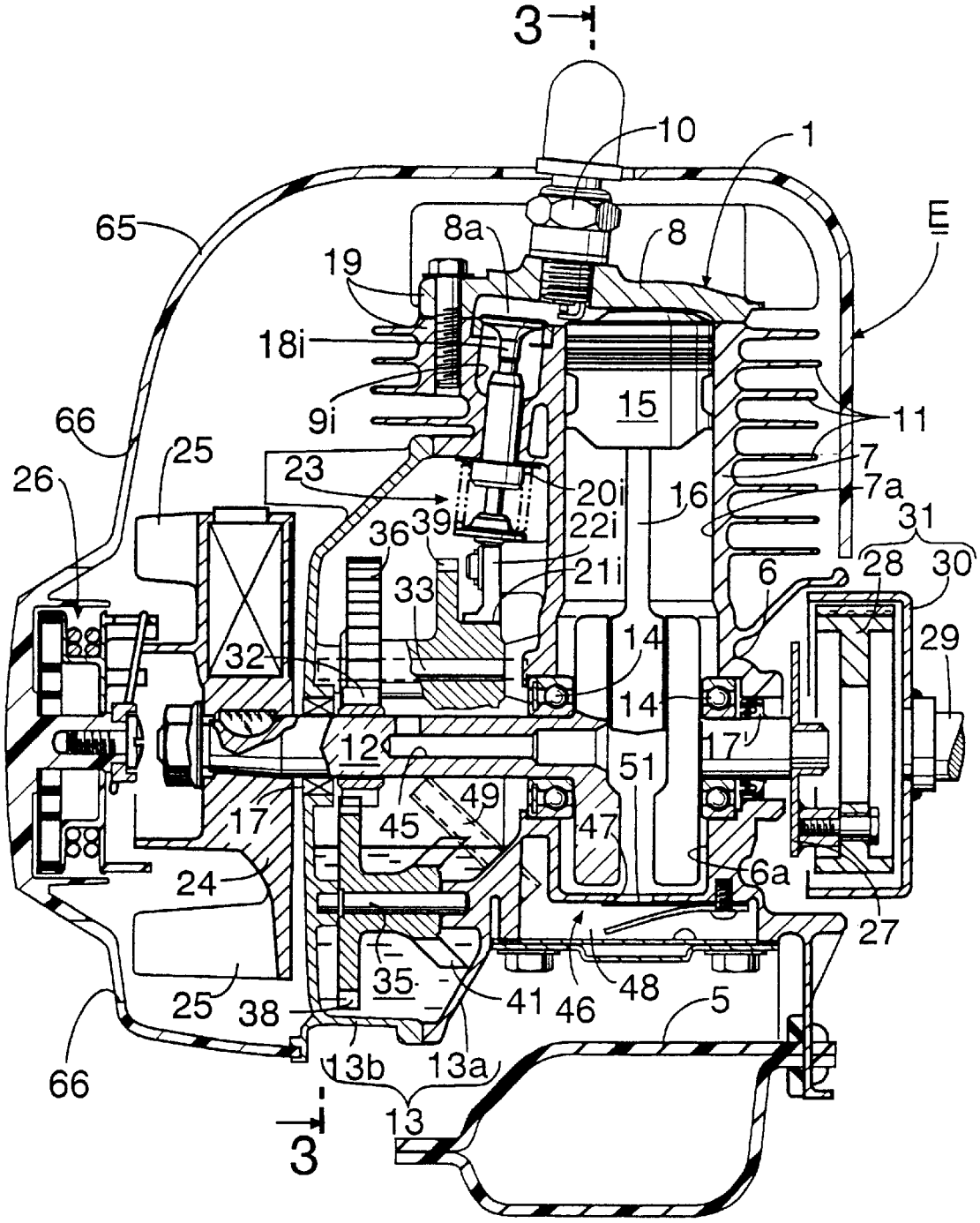
FIG. 2 is a vertically sectioned view of the above-mentioned four-cycle engine.
Figure 3:
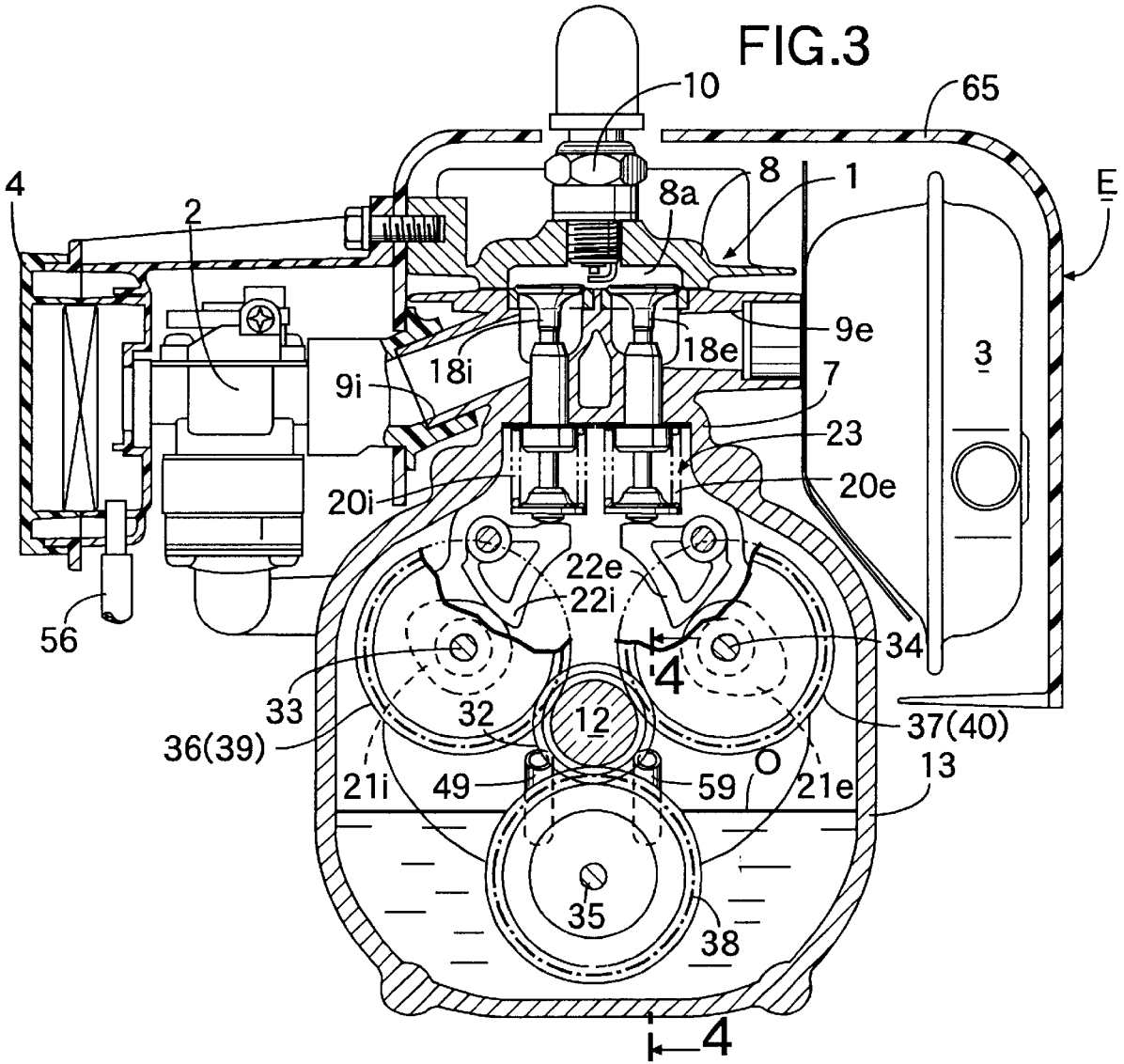
FIG. 3 is a cross-sectional view at line 3—3 in FIG. 2.
Figure 4:
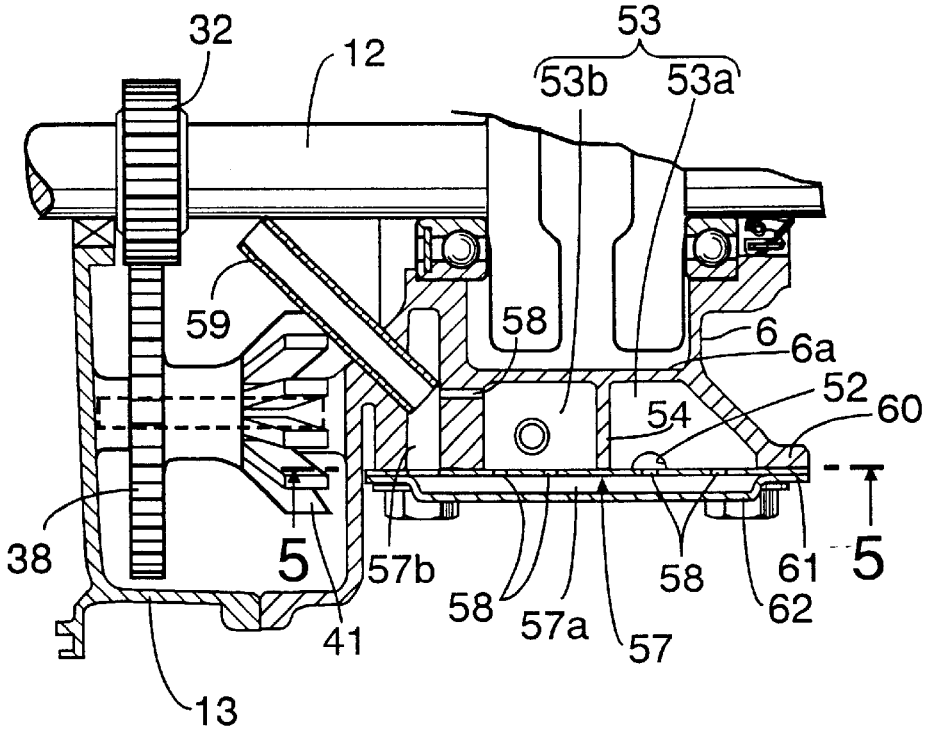
FIG. 4 is a cross-sectional view at line 4—4 in FIG. 3.
Figure 5:
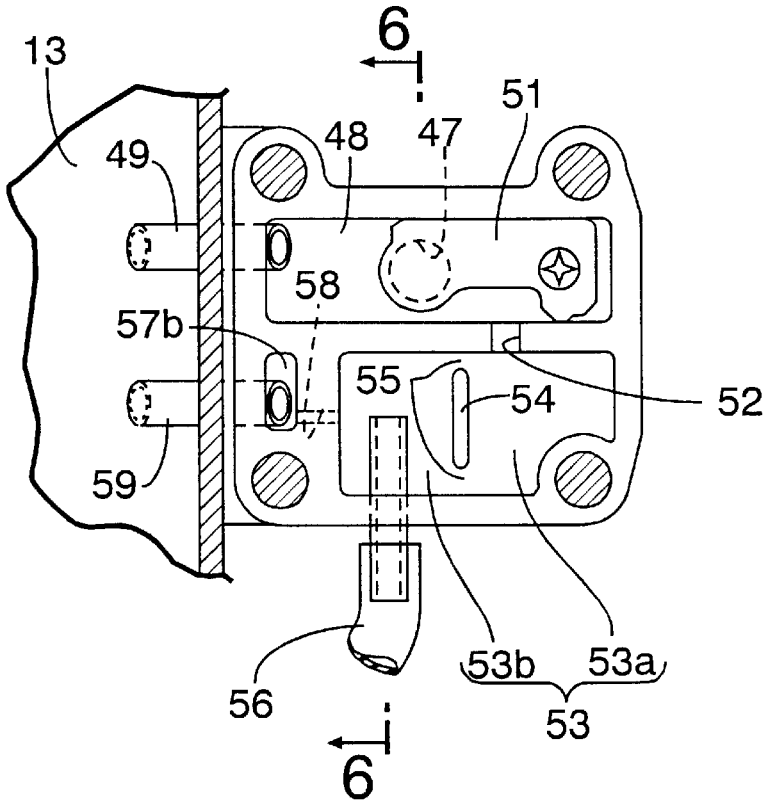
FIG. 5 is a cross-sectional view at line 5—5 in FIG. 4.
Figure 6:
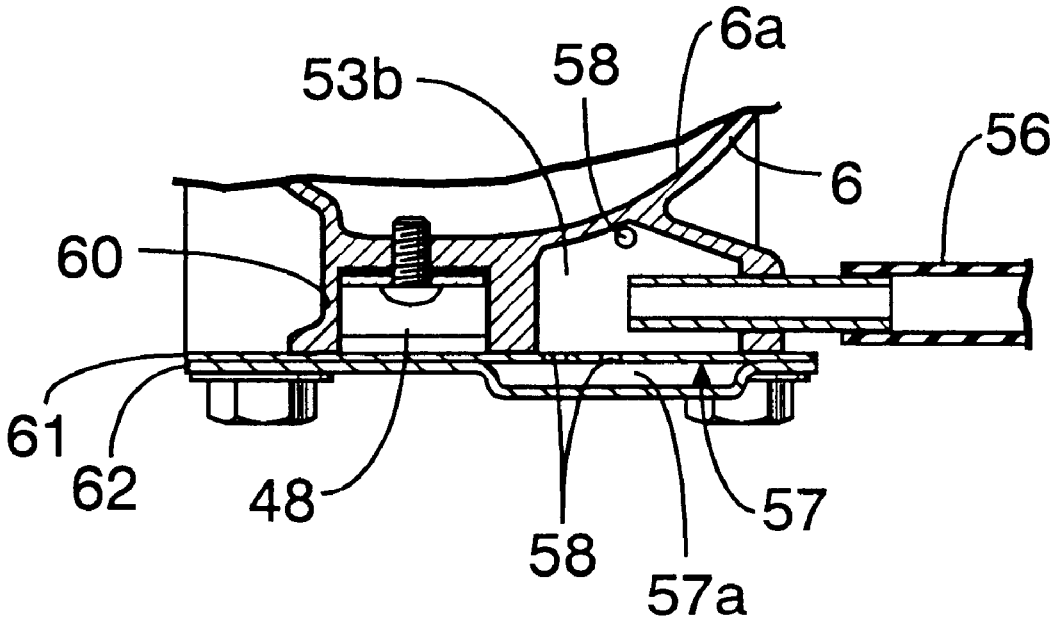
FIG. 6 is a cross-sectional view at line 6—6 in FIG. 5.

As shown in FIGS. 2 and 3, the engine main body 1 of the above-mentioned handheld type four-cycle engine E includes a crankcase 6 having a crank chamber 6*a*, a cylinder block 7 having one cylinder bore 7*a*, and a cylinder head 8 having a combustion chamber 8*a*, and a large number of cooling fins 11 are formed on the outer peripheries of the cylinder block 7 and the cylinder head 8.

The crankshaft 12 housed in the crank chamber 6*a* is supported in right and left side walls of the crankcase 6 in a rotatable manner via ball bearings 14 and 14' and is also connected to a piston 15 fitted in the cylinder bore 7*a* via a connecting rod 16.

An oil tank 13 is provided as a continuation of the left side wall running the length of the crankcase 6 and the cylinder block 7. The oil tank 13 includes a tank inner half 13*a* and a tank outer half 13*b*, the tank inner half 13*a* being linked integrally to the crankcase 6 and the cylinder block 7, and the tank outer half 13*b* being bolt-joined to the tank inner half 13*a*. The left-hand end of the crankshaft 12 runs through and projects out of the oil tank 13, and an oil seal 17 in close contact with the outer circumference of the crankshaft 12 is fitted in the tank outer half 13*b*.

A flywheel 24 having a large number of cooling vanes 25 is fixed to the left-hand end of the crankshaft 12 projecting out of the oil tank 13, the flywheel 24 functioning also as a cooling fan, and a recoil type starter 26 is placed outside the flywheel 24.

An oil seal 17' is fitted in the right side wall of the crankcase 6 so as to adjoin the outside of the bearing 14', the right-hand end of the crankshaft 12 runs through and projects out of the oil seal 17', a drive plate 27 is fixed to the right hand end of the crankshaft 12, and a plurality of centrifugal shoes 28 (one thereof is shown in the figure) are pivotally supported on the drive plate 27 in a rockable manner. These centrifugal shoes 28, together with a clutch drum 30 connected to the drive shaft 29 for driving the aforementioned cutter C, form a centrifugal clutch 31. When the rotational rate of the crankshaft 12 exceeds a predetermined value, the centrifugal shoes 28 are pressed onto the inner periphery of the clutch drum 30 due to the centrifugal force of the shoes, thereby transmitting the output torque of the crankshaft 12 to the drive shaft 29.

The cylinder block 7 and the cylinder head 8 share an overhang section 19 which overhangs on the side of the oil tank 13, and the lower part of the overhang section 19 forms a part of the upper wall of the tank inner half 13*a*. The combustion chamber 8*a* is formed in the part of the cylinder head 8 corresponding to this overhang section 19, and an intake port 9*i* and an exhaust port 9*e* communicated with the combustion chamber 8*a* are formed in the cylinder block 7. An ignition plug 10 is screwed into the cylinder head 8, the electrodes of the ignition plug 10 projecting into the combustion chamber 8*a*.

An intake valve 18*i* and an exhaust valve 18*e* are mounted in the overhang 19, that is to say, the upper wall of the tank inner half 13*a*, in a freely ascending and descending manner so that their valve heads project into the oil tank 13, the intake valve 18*i* and the exhaust valve 18*e* opening and closing the intake port 9*i* and the exhaust port 9*e* respectively. A valve operation mechanism 23 for operating the intake valve 18*i* and the exhaust valve 18*e* so as to open and close them is disposed inside the oil tank 13.

The valve operation mechanism 23 includes a drive gear 32 fixed to the crankshaft 12, a pair of driven gears 36 and 37 supported in a rotatable manner on a pair of support shafts 33 and 34 provided in the oil tank 13 above the crankshaft 12 and driven by the drive gear 32 with a reduction ratio of 1/2, an intake cam 21*i* and an exhaust cam 21*e* formed integrally with the driven gears 36 and 37 respectively, an intake cam follower 22*i* pivotally supported in the oil tank 13 in a rockable manner and provided between the intake cam 21*i* and the intake valve 18*i,* an exhaust cam follower 22*e* pivotally supported in the oil tank 13 in a rockable manner and provided between the exhaust cam 21*e* and the exhaust valve 18*e,* and valve springs 20*i* and 20*e* forcing the intake valve 18*i* and the exhaust valve 18*e* towards the closing direction. The engine E is thus arranged to be of the side valve type.

The driven gear 36 and the intake cam 21*i,* and also the driven gear 37 and the exhaust cam 21*e* are placed distant from each other in the axial direction so that they closely adjoin the left and right side walls respectively of the toil tank 13. Gear type oil slingers 39 and 40 are formed integrally with the intake cam 21*i* and the exhaust cam 21*e* respectively so as to adjoin them.

Another support shaft 35 is provided in the oil tank 13 at a position beneath the crankshaft 12, and this support shaft 35 supports a driven gear 38 and a vane type oil slinger 41 in a rotatable manner, the driven gear 38 being driven by the drive gear 32 and the oil slinger 41 being integral with the driven gear 38. The driven gear 38 and the oil slinger 41 are positioned distant from each other in the axial direction so that they closely adjoin the left and right inner walls respectively of the oil tank 13.

A predetermined amount of lubricating oil O is stored in the oil tank 13, at least one of the three driven gears 36 to 38 or the three oil slingers 39 to 41 is partially immersed in the stored oil O regardless of the operational position of the engine E, and the stored oil O is scattered by the rotation thereof so generating an oil mist. The three driven gears 36 to 38 therefore also function as oil slingers, and in fact, the three support shafts 33, 34 and 35 support a pair of oil slingers 36 and 39; 37 and 40; and 38 and 41 respectively, the oil slingers of each pair being distant from each other in the axial direction.

As shown in FIG. 3, the intake port 9*i* is connected to a carburettor 2 and an air cleaner 4 in that order, and the exhaust port 9*e* is connected to an exhaust muffler 3. The carburettor 2 and the exhaust muffler 3 are placed along a direction perpendicular to the axes of both the crankshaft 12 and the cylinder bore 7*a*.

The route for the circulation of oil mist between the oil tank 13 and the crank chamber 6*a* is explained below by reference to FIGS. 2 and 4 to 6.

An outward route 45 and an return route 46 for circulating the oil mist generated inside the oil tank 13 between the oil tank 13 and the crank chamber 6*a* are provided between the above-mentioned two chambers 13 and 6*a*. The outward route 45 includes a through hole formed in the crankshaft 12 and providing communication between the oil tank 13 and the crank chamber 6*a*. The return route 46 includes a valve hole 47 in the bottom wall of the crankcase 6, a valve chamber 48 communicated with the crank camber 6*a* via the valve hole 47, and a first return pipe 49 providing communication between the valve chamber 48 and the oil tank 13. A one-way valve 51 is provided in the valve chamber 48, the one-way valve 51 including a reed valve for blocking and unblocking the valve hole 47. The one-way valve 51 opens so as to unblock the valve hole 47 when a positive pressure is generated in the crank chamber 6*a* accompanying the ascending and descending movement of the piston 15, and the one-way valve 51 closes so as to close the valve hole 47 when a negative pressure is generated.

The open ends of the above-mentioned outward route 45 and the first return pipe 49 inside the oil tank 13 are arranged so that they are always above the liquid level of the stored oil O regardless of the operational position of the engine E.

A breather chamber 53 is provided on one side of the valve chamber 48, the breather chamber 53 being communicated with the valve chamber 48 via a link hole 52. The breather chamber 53 is partitioned into a plurality of expansion chambers 53*a,* 53*b* (two chambers in the figure) by means of a wall 54. These expansion chambers 53*a* and 53*b* are communicated with each other via throttle passages 55 and 55 on both sides of the wall 54, and the expansion chamber 53*b* furthest from the link hole 52 is communicated with the above-mentioned air cleaner 4 via a breather pipe 56.

A horizontally flattened chamber 57*a* is provided immediately below the breather chamber 53, a vertically flattened chamber 57*b* is provided in the side wall of the breather chamber 53 on the side of the oil tank 13, the vertically flattened chamber 57*b* rising at one end of the horizontally flattened chamber 57*a,* and a suction chamber 57 is formed by the two flattened chambers 57*a* and 57*b*. The horizontally flattened chamber 57*a* is communicated with the breather chamber 53 via orifices 58, 58 . . . separately placed at several positions, and the vertically flattened chamber 57*b* is also communicated with the breather chamber 53 via orifices 58, 58 . . . provided close to the ceiling of the breather chamber 53.

The suction chamber 57 is communicated with the inside of the oil tank 13 via a second return pipe 59. In the same way as for the first return pipe 49, in this case the second return pipe 59 is arranged so that the open end thereof inside the oil tank 13 is always above the liquid level of the stored oil O regardless of the operational position of the engine E.

The above-mentioned valve chamber 48 and the breather chamber 53 are formed between a surrounding wall 60 and a gasket 61, the surrounding wall 60 being formed integrally with the lower part of the crankcase 6 and the gasket 61 being joined to the lower end of the surrounding wall 60. The horizontally flattened chamber 57*a* is formed between the gasket 61 and a base plate 62 joined to the surrounding wall 60 in such a way that the periphery of the gasket 61 is interposed between the base plate 62 and the surrounding wall 60. The vertically flattened chamber 57*b* is formed in the dividing wall present between the breather chamber 53 and the oil tank 13.

Referring again to FIG. 2, an engine cover 65 is fixed to the engine main body 1 so as to cover it, a recoil type starter 26 is supported in the cover 65, and an air inlet 66 is provided in the engine cover 65 around the recoil type starter 26 so as to face cooling vanes 25 of the flywheel 24.

The action of the embodiment is explained below.

When the drive gear 32 rotates together with the crankshaft 12 during operation of the engine E, this rotation makes the three sets of oil slingers 36 and 39; 37 and 40; 38 and 41 supported in the three support shafts 33, 34, 35 rotate together. Since at least one of the oil slingers reliably scatters the stored oil O so as to generate an oil mist regardless of the operational position of the engine E, the inside of the oil tank 13 can always be filled with oil mist. The valve operation mechanism 23 is provided inside such an oil tank 13, the intake cam 21*i* and the exhaust cam 21*e* rotating together with the upper driven gears 36 and 37 operate the intake valve 18*i* and the exhaust valve 18*e* so as to open and close them with appropriate timing via the cam followers 22*i* and 22*e* while working co-operatively with the valve springs 20*i* and 20*e,* and each component of the valve operation mechanism 23 can therefore be lubricated effectively by the above-mentioned oil mist. It is therefore unnecessary to provide the engine main body 1 with a special oil supply passage for lubricating the valve operation mechanism 23, and the size and weight of the engine E can thus be reduced. Moreover, since the oil tank 13 is provided in one side wall running the length of the crankcase 6 and the cylinder block 7, it is unnecessary to provide an oil reservoir in the lower part of the crankcase 6, the total height of the engine E can be reduced and the size of the engine can further be reduced.

A negative pressure and a positive pressure are generated alternately in the crank chamber 6*a* accompanying the ascending and descending movement of the piston 15 so causing pressure pulsations; when a negative pressure is generated, the one-way valve 51 closes so as to block the valve hole 47 and at the same time the oil mist inside the oil tank 13 is drawn up into the crank chamber 6*a* through the through hole of the crankshaft 12, that is to say, the outward route 45 thus lubricating the crankshaft 12 and the piston 15. At this stage, the pressure of the oil tank 13 becomes negative due to the oil mist drawn up into the crank chamber 6*a*.

When a positive pressure is generated, the one-way valve 51 opens so as to unblock the valve hole 47, and the oil mist inside the crank chamber 6*a* is returned to the oil tank 13 having a low pressure through the return route 46, that is to say, the valve hole 47, the valve chamber 48 and the first return pipe 49. It is thus sufficient for the oil mist to circulate merely between the two chambers, namely the oil tank 13 and the crank chamber 6*a,* the outward route 45 and the return route 46 providing communication between the above-mentioned two chambers 13 and 6*a* can be made comparatively short and simple, and the size and weight of the engine main body 1 can be reduced.

Meanwhile, the blowby gas generated in the crank chamber 6*a* is transferred to the valve chamber 48 together with the oil mist and further to the breather chamber 53 through the link hole 52, and separated into gas and liquid while passing through the first and second expansion chambers 53*a* and 53*b,* and the blowby gas alone is discharged to the air cleaner 4 via the breather pipe 56.

The oil separated and liquefied in the breather chamber 53 flows into the suction chamber 57 via the orifice 58, 58 . . . Since the first suction chamber 57*a* and the second suction chamber 57*b* are communicated with the inside of the oil tank 13 having a low pressure via the second return pipe 59, the oil transferred to the suction chamber 57 is drawn up into the oil tank 13 through the second return pipe 59. Since the suction chamber 57 includes, in particular, the horizontally flattened chamber 57*a* and the vertically flattened chamber 57*b* rising at one end of the horizontally flattened chamber 57*a* as mentioned above, and each of the two chambers 57*a* and 57*b* is communicated with the breather chamber 53 via the orifices 58, 58, . . . , the oil stored in the breather chamber 53 can flow into the suction chamber 57 and return to the oil tank 13 even in the case where the engine E is tilted horizontally so positioning the vertically flattened chamber 57*b* downwards, as well of course in the case where the engine E is upright so positioning the horizontally flattened chamber 57*a* downwards.

Furthermore, since the flywheel 24 having the cooling vanes 25 driven by the crankshaft 12 is placed outside the oil tank 13 so as to adjoin it, cooling air drawn in through the air inlet 66 of the engine cover 65 by rotation of the cooling vanes 25 is directly applied to the oil tank 13, the oil mist and the oil O stored inside the oil tank can be cooled effectively and the lubrication and cooling of each part can be carried out efficiently.

Moreover, since the valve operation mechanism 23 and the centrifugal clutch 31 are linked to the two ends of the crankshaft 12 with the engine main body 1 disposed therebetween, the loads arising from the valve operation mechanism 23 and the drive shaft 29 during operation of the engine E separately work on the two ends of the crankshaft 12. It is therefore possible to prevent the load from being localised on the crankshaft 12, its bearings 14 and 14' and the side wall of the crankcase 6, and the durability thereof can thus be enhanced. Furthermore, since it is unnecessary to specially increase the load capacity of these parts, the engine E can be made more compact.

Moreover, since the carburettor 2 and the exhaust muffler 3 are placed along a direction perpendicular to the axes of both the crankshaft 12 and the cylinder bore 7*a,* the carburettor 2 and the exhaust muffler 3 can easily be arranged without any obstruction from the oil tank 13, the flywheel 24 or the centrifugal clutch 31 which are arranged along the axis of the crankshaft 12 thus helping to make the engine E more compact.

The present invention is not limited to the above-mentioned embodiment and can be modified in a variety of ways without departing from the spirit and scope of the invention, For example, a rotary valve operable in association with the crankshaft 12 and operating so as to unblock the outward pipe 45 when the piston 15 descends, and to block the outward pipe 45 when the piston 15 ascends can be provided instead of the one-way valve 51.

What is claimed is:

1. A handheld side-valve type four-cycle engine including:

a crankcase having a crank chamber housing a crankshaft;

a cylinder block having a cylinder bore; and an intake valve, an exhaust valve and a valve operation mechanism provided in a side wall extending along the crankcase and the cylinder block, the valve operation mechanism being operable in association with the crankshaft so as to open and close the intake valve and the exhaust valve;

wherein an oil tank for storing oil is provided in said side wall extending along the crankcase and the cylinder block, the oil tank houses therein the valve operation mechanism and oil mist generation means for generating oil mist from the stored oil, and said intake and exhaust valves project partly into said oil tank.

2. A handheld side-valve type four-cycle engine according to claim 1 wherein an outward route and a return route are provided for communication between the oil tank and the crank chamber above the oil stored in the oil tank, and valve means is provided in the return route, the valve means introducing the positive pressure component of pressure pulsations generated in the crank chamber into the side of the oil tank.

3. A handheld side-valve type four-cycle engine according to claim 1 or 2 wherein a breather chamber is communicated with a return route between valve means and the oil tank, and the breather chamber is communicated with an air cleaner of an intake system on one side and with a suction chamber communicated with the oil tank via an orifice on the other side.

4. A handheld side-valve type four-cycle engine including:

a crankcase having a crank chamber housing a crankshaft;

a cylinder block having a cylinder bore; and an intake valve, an exhaust valve and a valve operation mechanism provided in a side wall extending along the crankcase and the cylinder block, the valve operation mechanism being operable in association with the crankshaft so as to open and close the intake valve and the exhaust valve;

wherein an oil tank for storing oil that is separate from the crank chamber is provided in said side wall extending along the crankcase and the cylinder block and said intake and exhaust valves project partly into said oil tank, the oil tank houses therein the valve operation mechanism and oil mist generation means for generating oil mist from the stored oil and is arranged so that the oil mist generated inside the oil tank can be supplied to the crank chamber, a cooling fan driven by the crankshaft is placed so as to adjoin the oil tank, and a power output mechanism is provided on the crankshaft so that the crankcase is interposed between the power output mechanism and the oil tank.

5. A handheld side-valve type four-cycle engine according to claim 1 or 4 wherein a carburettor and an exhaust muffler are placed along a direction perpendicular to the axes of both the cylinder bore and the crankshaft on the two sides of the cylinder block.

6. A handheld side-valve type four-cycle engine according to claim 4, wherein said cooling fan is disposed outside said oil tank.

* * * * *